US010189598B2

(12) United States Patent
Ebe et al.

(10) Patent No.: US 10,189,598 B2
(45) Date of Patent: Jan. 29, 2019

(54) DISPLAY CARRIER

(71) Applicant: NEC Corporation, Tokyo (JP)

(72) Inventors: Shinichi Ebe, Tokyo (JP); Makoto Yanagisawa, Tokyo (JP)

(73) Assignee: NEC Corporation, Tokyo (JP)

( * ) Notice: Subject to any disclaimer, the term of this patent is extended or adjusted under 35 U.S.C. 154(b) by 60 days.

(21) Appl. No.: 14/389,198

(22) PCT Filed: Mar. 22, 2013

(86) PCT No.: PCT/JP2013/001942
§ 371 (c)(1),
(2) Date: Sep. 29, 2014

(87) PCT Pub. No.: WO2013/145664
PCT Pub. Date: Oct. 3, 2013

(65) Prior Publication Data

US 2015/0060325 A1 Mar. 5, 2015

(30) Foreign Application Priority Data

Mar. 29, 2012 (JP) ..... 2012-075420

(51) Int. Cl.
*B65D 25/54* (2006.01)
*B65D 5/42* (2006.01)
(Continued)

(52) U.S. Cl.
CPC ..... *B65D 5/4204* (2013.01); *A45C 11/00* (2013.01); *A45C 13/10* (2013.01); *A45C 2011/003* (2013.01)

(58) Field of Classification Search
CPC ..... B25H 3/02; B65D 5/52; B65D 5/5213; B65D 5/4204; B65D 25/54; G06F 1/1628;
(Continued)

(56) References Cited

U.S. PATENT DOCUMENTS 2,310,641 A * 2/1943 Lux ..... A47F 7/03 206/45.2
3,918,577 A * 11/1975 Horzick ..... B65D 85/40 206/216
(Continued)

FOREIGN PATENT DOCUMENTS

CN 1459406 12/2003
CN 1605549 4/2005
(Continued)

OTHER PUBLICATIONS

JP Office Action, dated Aug. 4, 2015; Application No. 2014-507411, with partial English translation.
(Continued)

*Primary Examiner* — Rafael Ortiz
(74) *Attorney, Agent, or Firm* — Young & Thompson

(57) ABSTRACT

A display carrier has: a storage box which stores a display; a fixing member which fixes the display in the inside of the storage box; a window part which is formed on a face which is opposite to a screen of the display when the display is fixed in the inside of the storage box among a plurality of faces of the storing box; and a closing member which closes the window part.

4 Claims, 11 Drawing Sheets

(51) Int. Cl.
*A45C 11/00* (2006.01)
*A45C 13/10* (2006.01)

(58) Field of Classification Search
CPC ..... G09F 5/00; G09F 5/02; G09F 5/04; A45C 11/00; A45C 13/10; A45C 2011/003
USPC ..... 206/773, 769, 770, 772, 775, 776, 320, 206/688, 751, 756, 301, 18, 70, 765, 736, 206/764, 305, 6.1, 316.1, 316.2, 730–735, 206/488, 486, 0.8; 220/379; 361/679.01, 361/679.02, 679.21; 455/575.1; 11/773, 11/769, 770, 772, 775, 776, 320, 688, 11/751, 756, 765, 736, 301, 18, 70
See application file for complete search history.

(56) References Cited

U.S. PATENT DOCUMENTS

| | | | | |
|---|---|---|---|---|
| 4,255,001 | A | 3/1981 | Frishman | |
| 5,383,552 | A * | 1/1995 | Dikowitz | A45C 11/10 206/301 |
| 5,868,268 | A * | 2/1999 | Walker | B65D 55/16 206/509 |
| 6,129,237 | A | 10/2000 | Miyahara | |
| 8,028,831 | B2 | 10/2011 | Kakuta | |
| 2005/0103815 | A1 | 5/2005 | Lee et al. | |
| 2005/0254352 | A1 | 11/2005 | Wolf et al. | |
| 2006/0169607 | A1 * | 8/2006 | Carnevali | G06F 1/1626 206/320 |
| 2007/0151899 | A1 * | 7/2007 | Chun | B65D 25/10 206/775 |
| 2007/0227943 | A1 * | 10/2007 | Foushee | B65D 5/4204 206/775 |
| 2009/0017883 | A1 | 1/2009 | Lin | |
| 2009/0294320 | A1 * | 12/2009 | Wolf, V | G04B 3/006 206/486 |
| 2012/0043235 | A1 * | 2/2012 | Klement | A45C 11/00 206/320 |

FOREIGN PATENT DOCUMENTS

| | | |
|---|---|---|
| DE | 19828193 | 1/2000 |
| JP | 05-31315 | 4/1993 |
| JP | 05-100314 | 4/1993 |
| JP | 11-9325 | 1/1999 |
| JP | 3087540 | 5/2002 |
| JP | 2002-280753 | 9/2002 |
| JP | 2004-016360 | 1/2004 |
| JP | 2004-16360 | 1/2004 |
| JP | 2005-136580 | 5/2005 |
| JP | 2005-145452 | 6/2005 |
| JP | 2005-200058 | 7/2005 |
| JP | 2005-217895 | 8/2005 |
| JP | 2007-022618 | 2/2007 |
| JP | 2008-294179 | 12/2008 |
| JP | 2009067421 A | 4/2009 |

OTHER PUBLICATIONS

International Search Report PCT/JP2013/001942 dated Jun. 18, 2013.
CN Office Action, dated Dec. 3, 2015; Application No. 2013800176642.
KR Office Action, dated Jan. 13, 2016; Application No. 10-2014-7027420.
Extended European Search Report dated Dec. 22, 2015; Application No. 13768766.1.
Japanese Office Action dated Jul. 25, 2017; Application No. 2014-507411.
European Official Action—13 768 766.1—dated Aug. 10, 2018.

* cited by examiner

DISPLAY CARRIER

TECHNICAL FIELD

The present invention relates to a display carrier for carrying a display such as a flat panel display.

BACKGROUND ART

Chances to carry a display represented by a flat panel display for a meeting or a presentation at a customer's office and the like are increasing. Such display is not necessarily tough against an external factor such as sunlight, dust, temperature, humidity or an impact due to its fall. Therefore, in the case of the carrying, there is adopted a method to cover a display with a display cover formed of rubber or the like, or to store a display in a storage case formed of metal or the like.

In patent literature 1, there is a description about a technology in which all means for performing enlarged display of a still picture and an animation are stored in a portable case.

In patent literature 2, there is a description about a technology which makes carrying of a system easy by, after installing, connecting and adjusting all pieces of configuration equipment and components in an operable state, storing them in a single rack in a folded manner.

CITATION LIST

Patent Literature

[Patent literature 1] Japanese Patent Application Laid-Open No. H05 (1993)-100314

[Patent literature 2] Japanese Utility Model Patent No. 3087540

SUMMARY OF INVENTION

Technical Problem

In the case of the above-mentioned display cover, it usually has a structure to make only a display part be exposed because operability cannot be sacrificed. In other words, the above-mentioned display cover has some degree of effect on an impact by a fall or the like, but cannot block dust and sunlight off completely.

On the other hand, because the above-mentioned storing case is of a structure to store the whole of a display, the display can be protected from most of external factors. However, in the case of a general storage case, it merely stores the display. Accordingly, the display may move inside the storing case. By this, there is a possibility that an outer wall of the display and an inner wall of the storage case are rubbed with each other, and the outer wall of the display is damaged.

The technology of patent literature 1 is a technology to store a complete set of equipment for performing expanded projection of an image, and is not a technology for storing a general display mentioned above. Accordingly, in the technology of patent literature 1, there is a possibility that the display moves inside a case when storing the general display mentioned above. That is, in the technology of patent literature 1, the general display mentioned above cannot be protected from an external factor and thus cannot be carried safely.

An object to be stored in a rack in patent literature 2 is a system under a condition that all pieces of configuration equipment and components are installed, connected and adjusted in a operable state (specifically, a computer system including a camera, a display, a printer and the like), and thus it is not the general display mentioned above. Accordingly, in the technology of patent literature 2, there is a possibility that the display will move in the inside of the case, when the general display mentioned above is stored in the case. That is, in the technology of patent literature 2, the general display mentioned above cannot be protected from an external factor and cannot be carried safely.

The present invention has been made in order to settle the above-mentioned problem, and provides a display carrier capable of carrying the general display safely.

Solution to Problem

A display carrier of the present invention has: a storage box which stores a display; a fixing member which fixes the display in the inside of the storage box; a window part which is formed on a face which is opposite to a screen of the display when the display is fixed in the inside of the storage box among a plurality of faces of the storing box; and a closing member which closes the window part.

Meanwhile, various components of the present invention do not need to be entities independent of each other necessarily, and thus cases that: a plurality of components are formed as one member; one component is formed of a plurality of members; a certain component is a part of another component; and a part of a certain component and a part of another component overlap with each other are also allowed.

Advantageous Effects of Invention

According to the present invention, a display can be carried safely.

DESCRIPTION OF EMBODIMENTS (First Exemplary Embodiment)

(Description of a Structure)

The first exemplary embodiment of the present invention will be described below with reference to FIGS. 1 to 5. A display carrier 1000 of this exemplary embodiment has a storage box 1100, a fixing member 1120 and a closing member 1130.

The storage box 1100 stores a display 1200 having a display screen 1210. The fixing member 1120 fixes the display 1200 inside the storage box 1100.

A window part 1110 for visually recognizing the display screen 1210 from outside is formed in a face of the storage box 1100 facing the display screen 1210 of the display 1200 which has been fixed. The closing member 1130 closes the window part 1110.

The display 1200 is a liquid crystal display or a plasma display of a panel shape, for example. The display screen 1210 is formed into a quadrangle shape (a rectangle, for example).

Figures 1A, 1B, 1C:
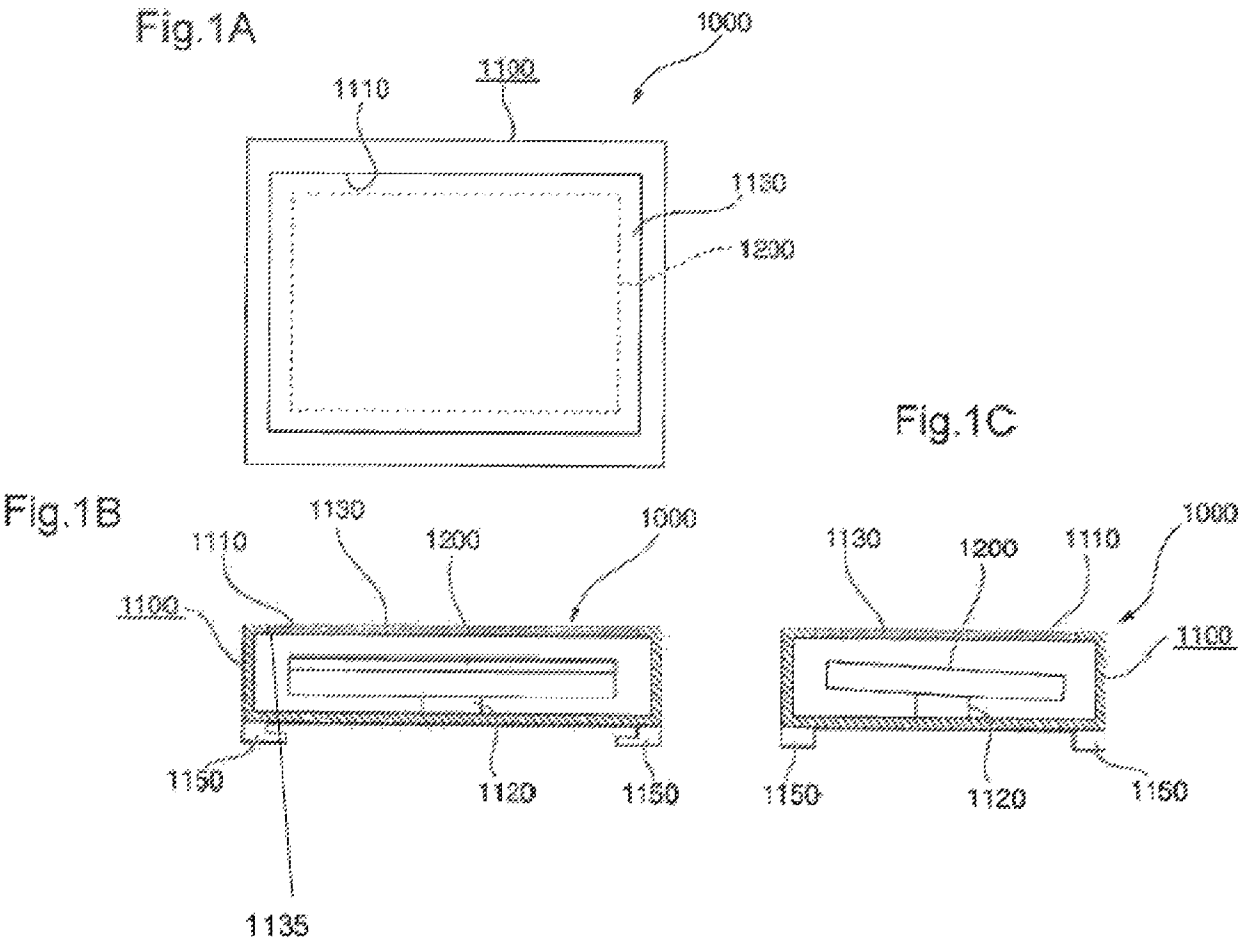
FIG. 1 indicates a trihedral figure of a display carrier according to a first exemplary embodiment of the present invention under a condition that a display is stored in a storage box and a window part is closed by a closing member.
Figure 2A:
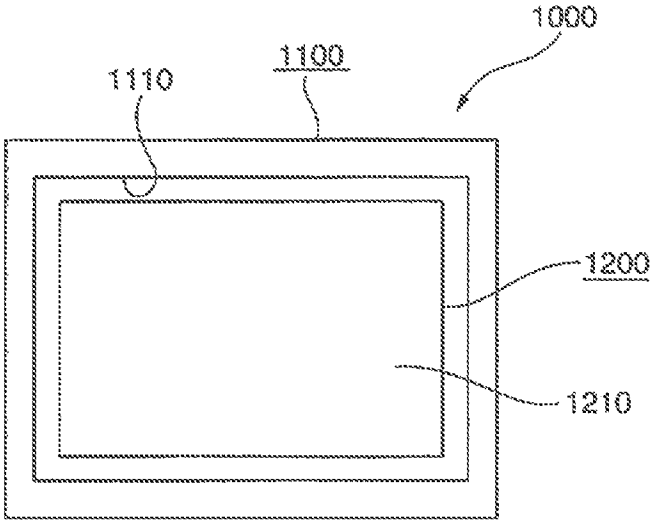
FIG. 2 indicates a trihedral figure of a display carrier according to the first exemplary embodiment of the present invention under a condition that a display is stored in a storage box and a window part is not closed by a closing member.
Figure 2B:
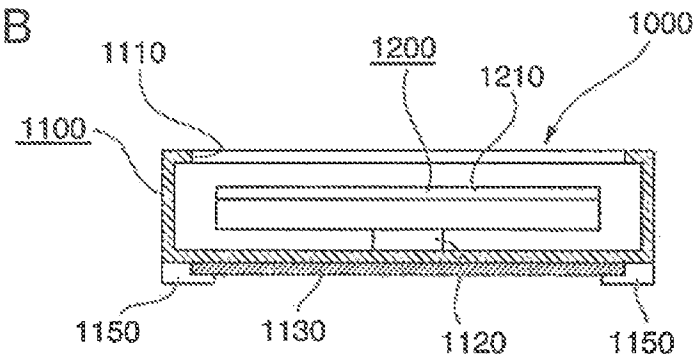
Figure 2C:
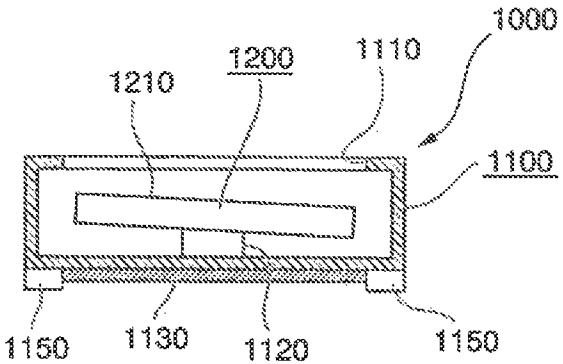

As shown in FIG. 1 and FIG. 2, the storage box 1100 is formed into a hollow structure that accommodates the display 1200. The window part 1110 is usually formed as a quadrangle-shape penetration hole having a size which allows the whole display screen 1210 to be visually recognized (in other words, a size that the display 1200 can be taken in and out).

Figure 3:
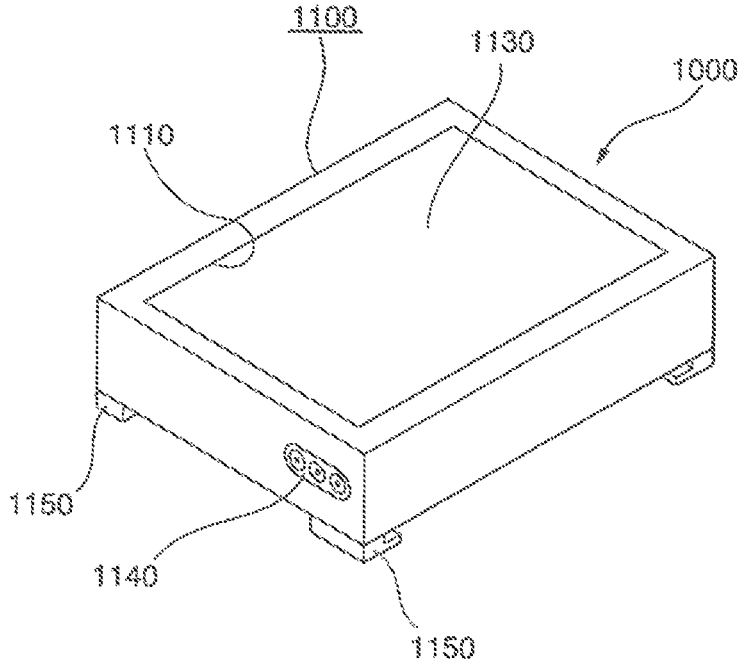
FIG. 3 indicates a perspective view of a display carrier according to the first exemplary embodiment of the present invention under a condition that a window part is closed by a closing member.
Figure 4:
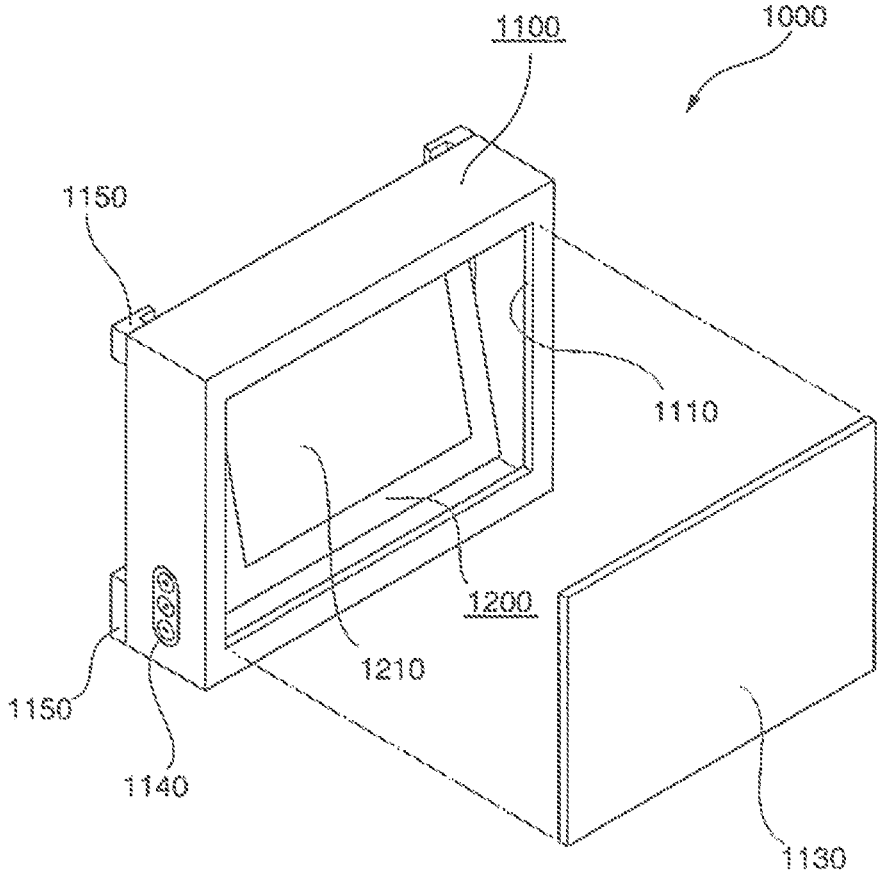
FIG. 4 indicates an exploded perspective view of a display carrier according to the first exemplary embodiment of the present invention under a condition that a display is stored in a storage box, the storage box is placed vertically, and a window part is not closed by a closing member.
Figure 5:
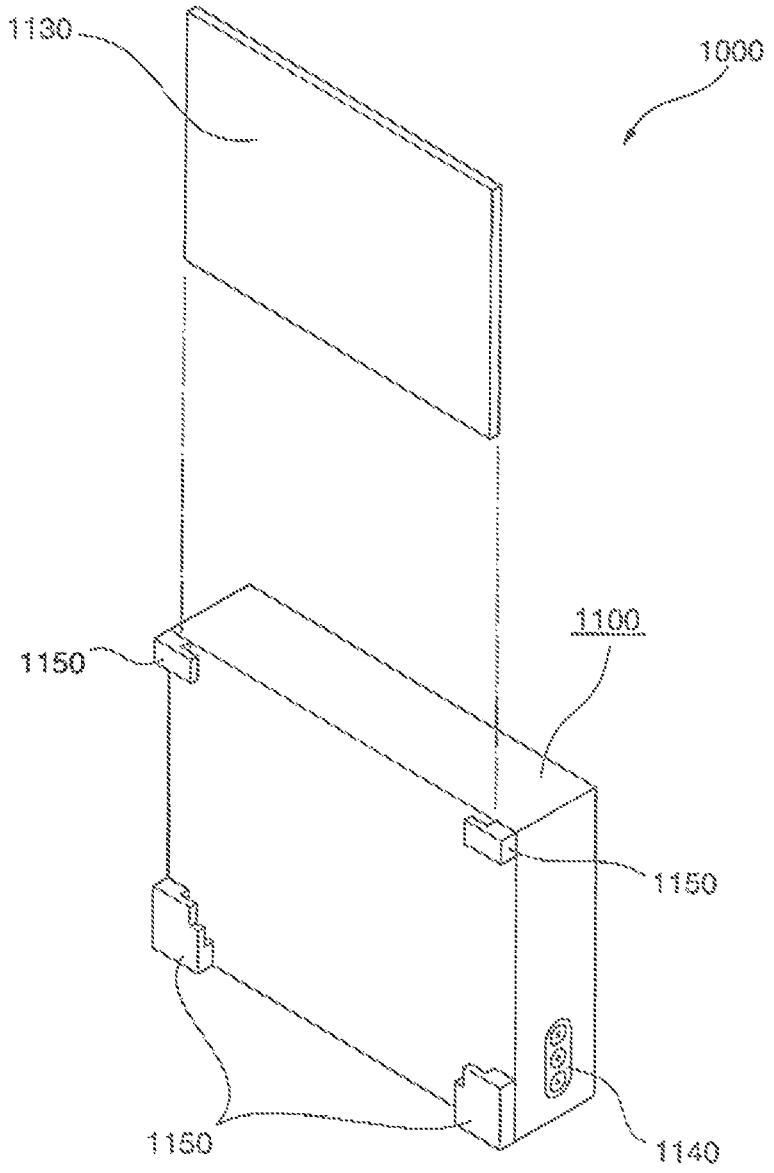
FIG. 5 indicates an exploded perspective view of a display carrier according to the first exemplary embodiment of the present invention for describing a supporting method of a closing member by a supporting member.

As shown in FIGS. 3 to 5, a connection connector 1140 for connecting a cable which is an interface to an external device (not illustrated; a cellular phone or a laptop computer, for example) is formed at a predetermined position of the storage box 1100. In the inside of the storage box 1100, the connection connector 1140 and the display 1200 are connected directly or via a cable.

The fixing member 1120 is disposed entirely within the storage box 1100 and is provided at a predetermined position inside the hollow of the storage box 1100 at a central area of the storage box 1100. The fixing member 1120 may be integrally formed with the storage box 1100. Alternatively, the fixing member 1120 may be separated from the storage box 1100, and, at the time of assembly, may be joined to the storage box 1100 by a predetermined joining method. The rear surface (a face opposite to the display screen 1210) of the display 1200 is joined to the fixing member 1120 by a predetermined connecting method (a self-adhesive tape, for example). As a result, the display 1200 does not move in the hollow of the storage box 1100. In this case, the display 1200 is fixed on a position where an outside surface of the display 1200 does not touch an inside surface of the storage box 1100.

The upper surface of the fixing member 1120 is not parallel to the window part 1110, and inclines at a predetermined angle. Accordingly, the fixing member 1120 fixes the display 1200 such that the display screen 1210 will be in a state that it is inclined relative to the window part 1110 at a predetermined angle.

In this exemplary embodiment, the closing member 1130 is formed by one plate-like member. The closing member 1130 can be attached to and detached from a sealing member 1135 (rubber packing, for example) formed in the periphery of the window part 1110.

A supporting member 1150 to support the closing member 1130 attachably and detachably is provided in a face of the storage box 1100 opposite to the face in which the window part 1110 is formed on a face of the storage box 1100 opposite to the face in which the window part 1110 is formed.

For example, as shown in FIG. 5, pieces of supporting member 1150 are formed in the four corners of the under surface of the storage box 1100. When the storage box 1100 is placed vertically (such that the window part 1110 is placed substantially vertically), the closing member 1130 should be loaded by being slid from the upper side to the lower side in the back of the storage box 1100.

The supporting member 1150 not only stores the closing member 1130 removed from the window part 1110, but also becomes a leg part of the storage box 1100 itself when the storage box 1100 is placed horizontally (such that the window part 1110 is placed substantially horizontally) as shown in FIG. 1 and FIG. 2.

It is preferred to form the storage box 1100 and the closing member 1130 by a high rigidity material (resin and aluminum alloy, for example) or the like because it is possible to protect the display 1200 from an external shock more certainly. Also, it is preferred to form the storage box 1100 and the closing member 1130 by a material excellent in thermal insulating properties because temperature of the display 1200 can be kept constant.

(Description about a Series of Work from Storing a Display to Visual Recognition)

When it is confirmed that the closing member 1130 is removed and the window part 1110 is open, the display 1200 is stored inside the storage box 1100 from the window part 1110 and is fixed to the fixing member 1120. Next, the window part 1110 is closed by the closing member 1130. Accordingly, as shown in FIG. 1 and FIG. 3, the display 1200 is sealed by the storage box 1100 and the closing member 1130. When the display 1200 is in such state, the display 1200 is carried by the display carrier 1000.

When the carrying is completed and the display 1200 is used (when a meeting or presentation is conducted at a customer's site, for example), the closing member 1130 is removed from the window part 1110. The storage box 1100 is placed vertically (refer to FIG. 4) so as to make the window part 1110 be in an approximately vertical state. The display screen 1210 of the display 1200 is exposed to the window part 1110 of the storage box 1100.

In this state, a plug cable of a data output device such as a portable terminal is connected to the connection connector 1140, and information (image data, for example) is outputted to the data output device. Users (people who participate in a meeting, for example) can visually recognize information indicated on the display screen 1210 via the window part 1110.

Meanwhile, as shown in FIG. 2 and FIG. 5, the closing member 1130 that has been removed is supported by the supporting member 1150 formed in the back of the storage box 1100.

(Description of an Effect)

In the case of the display carrier 1000 of this exemplary embodiment, the display 1200 stored in the storage box 1100 can be sealed from outside because the window part 1110 is closed by the closing member 1130. Therefore, the display 1200 can be protected from an external factor. The display 1200 is fixed by the fixing member 1120. Therefore, the display 1200 does not move in the inside of the storage box 1100. Accordingly, a risk of damages of an outer wall of the display 1200 due to rubbing of the outer wall of the display 1200 with an inner wall of the storage box 1100 is avoided. In this case, when fixing the display 1200 at a position with which its outside does not touch an inside face of the storage box 1100, even if an impact acts on the storage box 1100 during the carrying, it is possible to prevent this impact from acting on the display 1200 directly.

In summary, a general display (a liquid crystal display or a plasma display of a panel shape, for example) can be carried safely according to this exemplary embodiment.

The closing member 1130 can be attached to and detached from a sealing member formed in the periphery of the window part 1110 (rubber packing, for example). As a result, it becomes possible to improve airtightness in the storage box 1100 while maintaining workability about attachment/detachment of the closing member 1130.

In addition, in the case of this exemplary embodiment, information which is indicated on the display screen 1210 can be visually recognized under a condition that the display 1200 is stored in the storage box 1100 without being taken out from the storage box 1100.

The fixing member 1120 fixes the display 1200 such that the display screen 1210 is inclined relative to the window part 1110. For this reason, as shown in FIG. 4, the display screen 1210 will be in a backward-tilting state when the storage box 1100 is placed vertically. Therefore, visibility of the display screen 1210 can be improved.

The window part 1110 is formed as a penetration hole. Accordingly, when the display 1200 is a display of a touch panel type, for example, a user can touch the display screen 1210. That is, operability of a display is not deteriorated.

Further, as shown in FIG. 5, the storage box 1100 has the supporting member 1150 to support the closing member 1130 attachably and detachably in a face opposite to the window part 1110. For this reason, the closing member 1130 removed from the window part 1110 does not become an obstacle, and loss of the removed closing member 1130 can also be prevented. Moreover, as shown in FIG. 3, when the storage box 1100 is placed horizontally, the supporting member 1150 also functions as a leg part of the storage box 1100.

Meanwhile, the present invention is not limited to this exemplary embodiment, and various modifications are permitted within the range that does not deviate from the scope of the present invention. For example, in the above-mentioned embodiment, it has been illustrated that the display carrier 1000 is formed by storing the display 1200 that is general in the storage box 1100 and fixing it using the fixing member 1120. However, a portable type display device in which a dedicated display is stored in the storage box 1100 at the time of production and fixed by the fixing member 1120 can be also implemented.

Also, in this exemplary embodiment, it has been illustrated that the window part 1110 includes a penetration hole. However, such image-visible window part may be sealed by a translucent plate such as glass and resin (not shown).

(Second Exemplary Embodiment)

Figure 6:
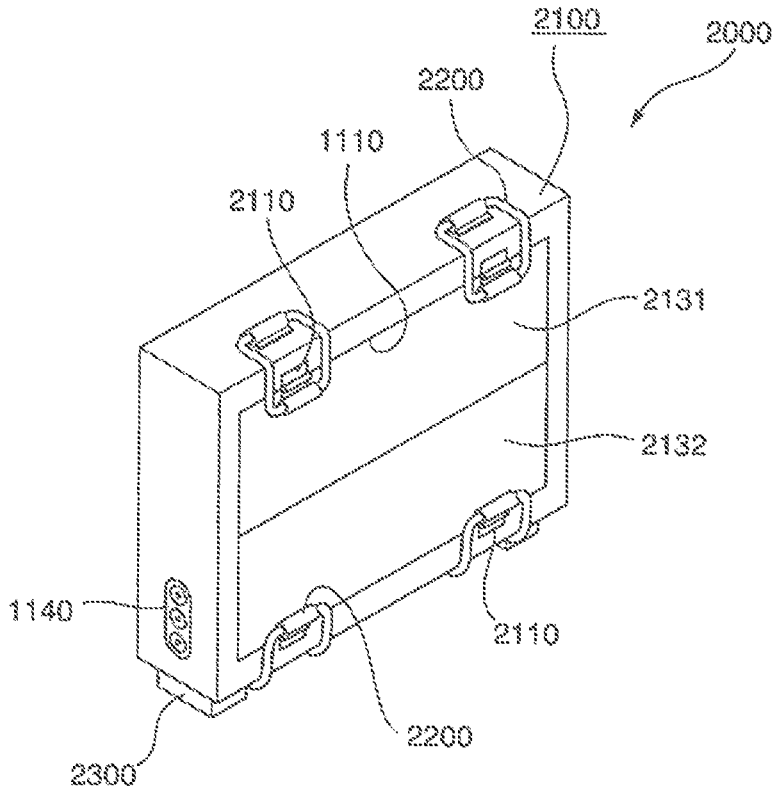
FIG. 6 indicates a perspective view of a display carrier according to a second exemplary embodiment of the present invention under a condition that a window part is closed.
Figure 7:
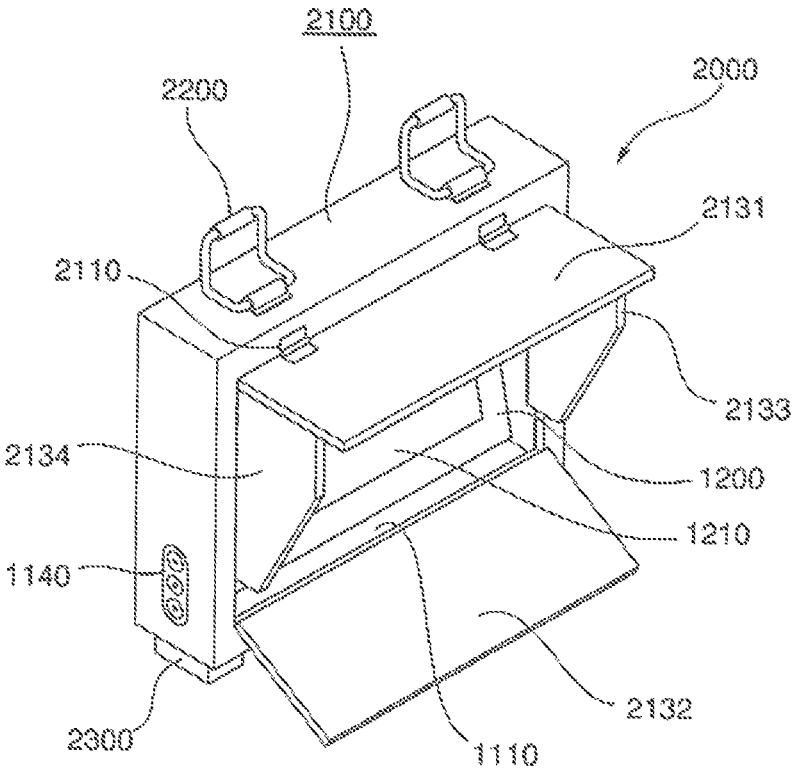
FIG. 7 indicates a perspective view of a display carrier according to the second exemplary embodiment of the present invention under a condition that a window part is exposed.

Each of FIG. 6 and FIG. 7 indicates a perspective view of a display carrier 2000 according to the second exemplary embodiment of the present invention. FIG. 6 is a perspective view of a state that the window part is closed, and FIG. 7 is a perspective view of a state that the window part is exposed. Meanwhile, FIG. 6 and FIG. 7 indicate the state that the display carrier 2000 is placed vertically.

The display carrier 2000 includes a pair of upper and lower closing members 2131 and 2132. The closing member 2131 is rotatably attached to the upper end part of the window part 1110 via a hinge mechanism 2110. The closing member 2132 is rotatably attached to the lower end part of the window part 1110 via the hinge mechanism 2110.

Further, as shown in FIG. 7, the display carrier 2000 includes a pair of right and left closing members 2133 and 2134. The closing member 2133 is rotatably attached to the right end part of the window part 1110 via a hinge mechanism (not shown). The closing member 2134 is rotatably attached to the left end part of the window part 1110 via a hinge mechanism (not shown). About attachment positions of the pair of right and left closing members 2133 and 2134, these are attached at positions deeper than attachment positions of the pair of upper and lower closing members 2131 and 2132 by a certain amount (an amount corresponding to the plate thickness of the closing members 2131 and 2132, for example).

As shown in FIG. 7, the closing member 2131 is held by the pair of right and left closing members 2133 and 2134 when it is open.

In the upper part and the lower part of a storage box 2100, there is provided a stopper 2200 for fixing movement of the pair of upper and lower closing members 2131 and 2132 in order to maintain closing of the pair of upper and lower closing members 2131 and 2132 when it is closed. There is provided a leg part 2300 for preventing interference between the stopper 2200 and a floor surface is formed in the lower part of the storage box 2100.

According to the second exemplary embodiment described above, the same effect as the first exemplary embodiment can be obtained.

Furthermore, in the case of the second exemplary embodiment, because the closing members 2131, 2133 and 2134 also function as a light shielding structure to prevent the surrounding ambient light, visibility of the display screen 1210 is improved.

The closing members 2131, 2132, 2133 and 2134 are in a state that they are connected with the storage box 2100 by hinge mechanisms, and thus they are not separated. Accordingly, there is no need to worry about tidying and their loss.

Meanwhile, by applying antireflection coating to the inner walls of the closing member 2131, 2133 and 2134 and the storage box 2100, a diffused reflection in the inner walls of the closing members 2131, 2132, 2133 and 2134 and the storage box 2100 is prevented, and thus visibility of the display screen 1210 is improved further.

Meanwhile, although there are a plurality of closing members (a total of four: 2131, 2132, 2133 and 2134) in the second exemplary embodiment described above, the number of closing members may be one only if it is rotatably connected to the storage box 2100 via a hinge mechanism.

(Third Exemplary Embodiment)

Figure 8:
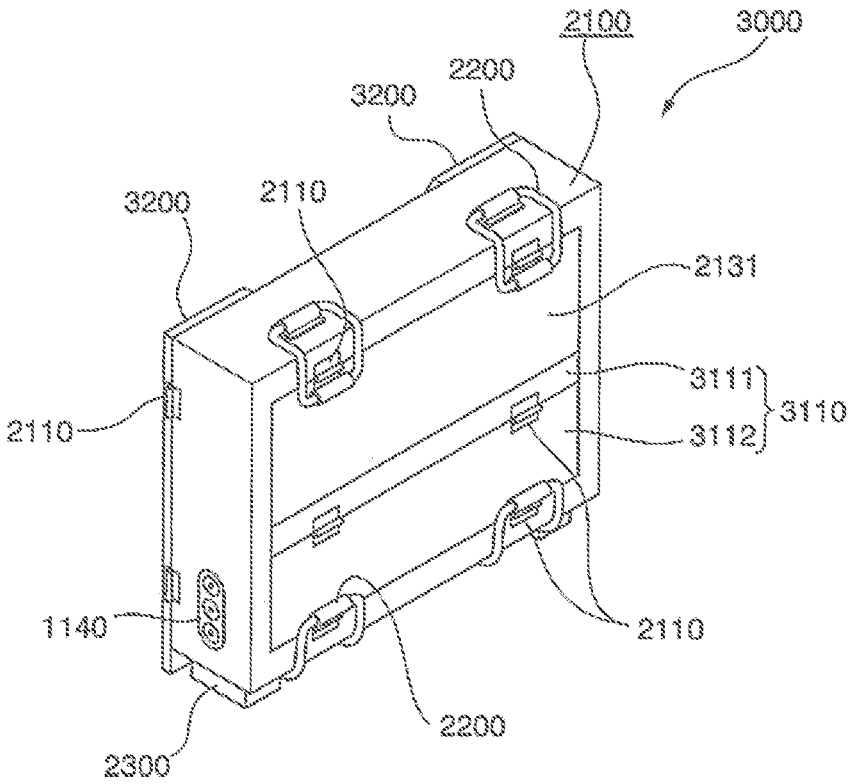
FIG. 8 indicates a perspective view of a display carrier according to a third exemplary embodiment of the present invention under a condition that a window part is closed.
Figure 9:
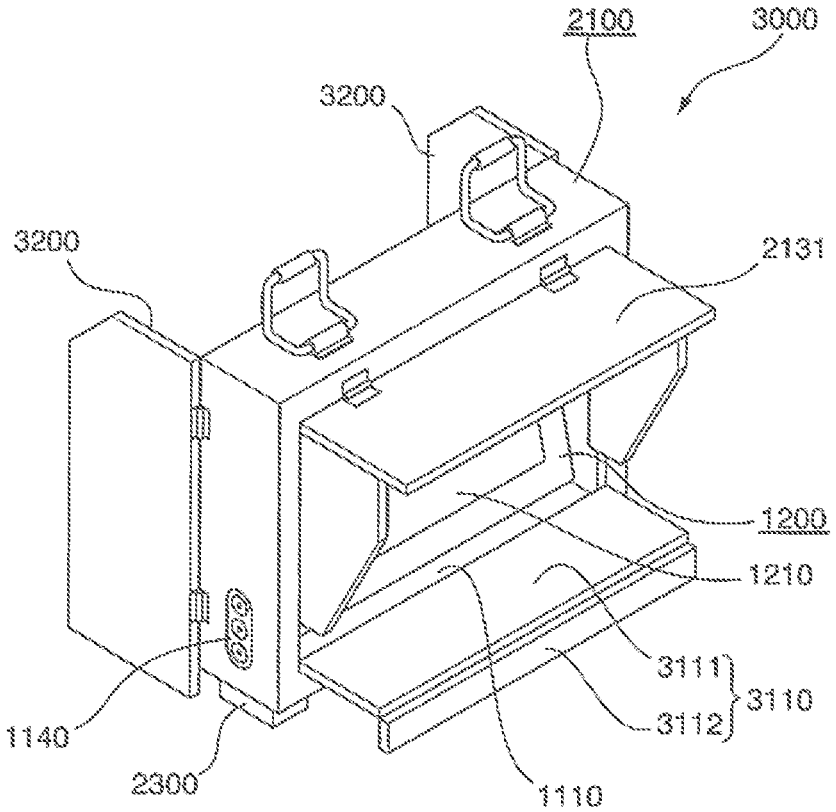
FIG. 9 indicates a perspective view of a display carrier according to the third exemplary embodiment of the present invention under a condition that a window part is exposed.

FIG. 8 and FIG. 9 indicate perspective views of a display carrier 3000 according to the third exemplary embodiment of the present invention, respectively. FIG. 8 is a perspective view of a state that a window part is closed, and FIG. 9 is a perspective view of a state that the window part is exposed. Meanwhile, FIG. 8 and FIG. 9 indicate a state where the display carrier 3000 is placed vertically.

The structure of the display carrier 3000 is identical with the display carrier 2000 except for a part. Accordingly, an identical reference symbol is given to an identical component, and description about such components will be omitted.

In the display carrier 3000, an underside closing member 3110 is divided into two pieces: a first closing part 3111 and a second closing part 3112. The first closing part 3111 and the second closing part 3112 are rotatably connected with each other via the hinge mechanism 2110.

As shown in FIG. 9, the second closing part 3112 will be in a state that it bends approximately perpendicularly to the first closing part 3111 at the time when it is open, and its bottom end touches a floor surface. By such closing member 3110, fall of the storage box 2100 on its front is prevented.

In addition, a pair of right and left pieces of box supporting member 3200 is connected rotatably in predetermined positions of the back or side faces of the storage box 2100. As shown in FIG. 9, by opening the pair of right and left box supporting members 3200 backward, fall of the storage box 2100 on its back is prevented.

According to the third exemplary embodiment described above, the same effect as the second exemplary embodiment can be obtained.

Furthermore, in the case of the third exemplary embodiment, fall of the storing box 2100 placed vertically on its front or its back can be prevented more certainly.

(Fourth Exemplary Embodiment)

Figure 10:
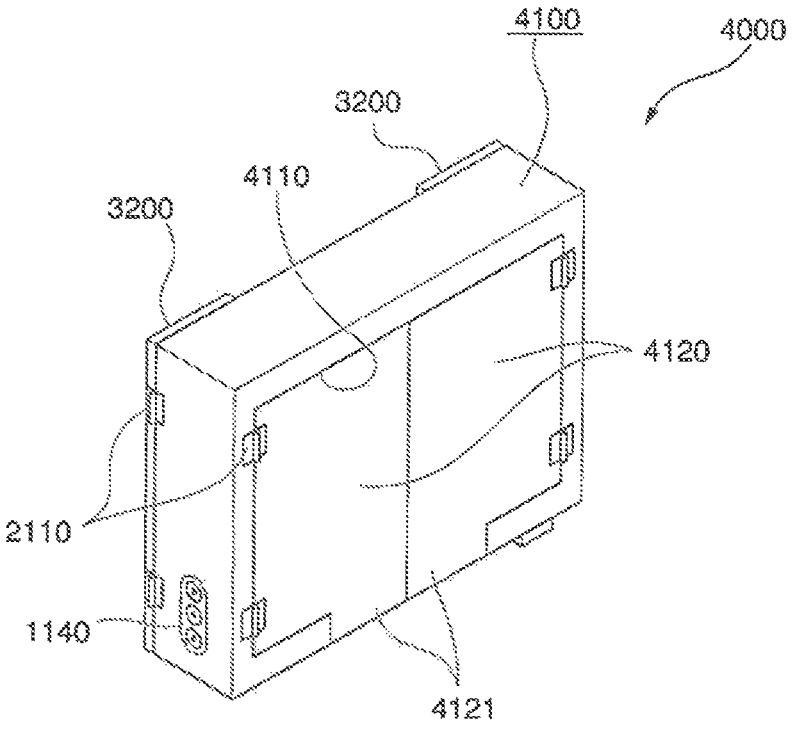
FIG. 10 indicates a perspective view of a display carrier according to a fourth exemplary embodiment of the present invention under a condition that a window part is closed.
Figure 11:
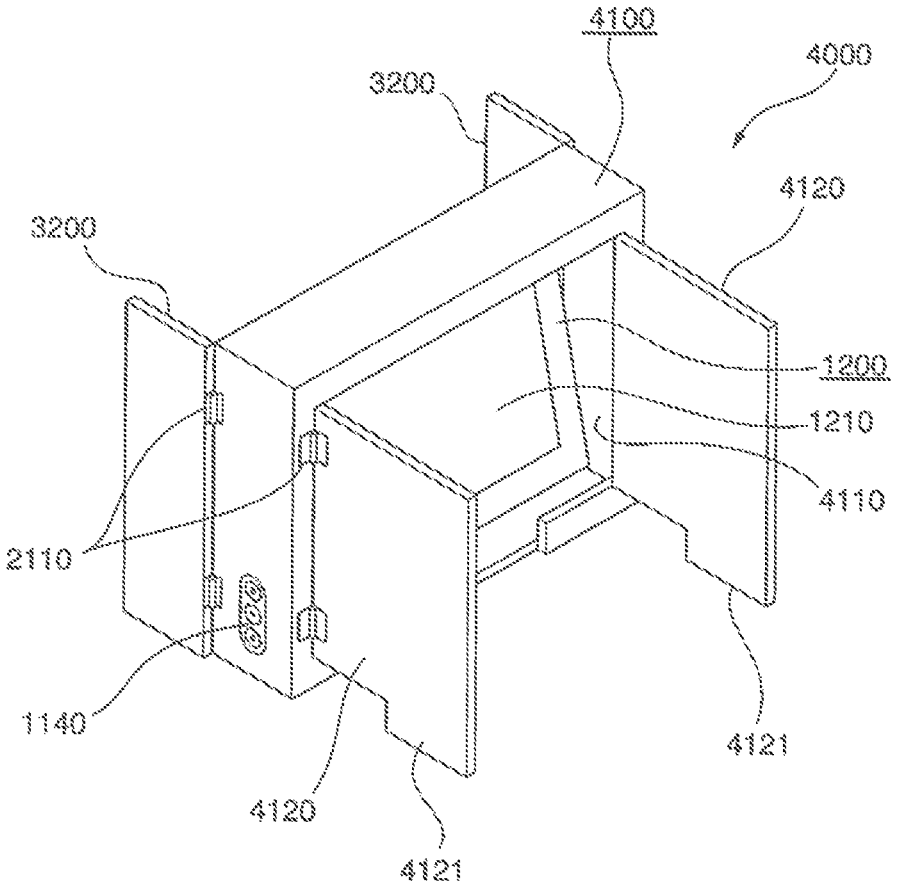
FIG. 11 indicates a perspective view of a display carrier according to the fourth exemplary embodiment of the present invention under a condition that a window part is exposed.

FIG. 10 and FIG. 11 indicate perspective views of a display carrier 4000 according to the fourth exemplary embodiment of the present invention, respectively. FIG. 10 is a perspective view of a state that a window part is closed, and FIG. 11 is a perspective view of a state that the window part is exposed. Meanwhile FIG. 10 and FIG. 11 indicate a state where the display carrier 4000 is placed vertically.

The structure of the display carrier 4000 is identical with that of the display carrier 3000 except for a part. Accordingly, an identical reference symbol is given to an identical component, and description of such components is omitted.

Each closing member 4120 of left and right is openably and closably attached to the left and right ends of a window part 4110 of a storage box 4100 via the hinge mechanism 2110. A box-supporting convex portion 4121 is formed in the lower end parts of each closing member 4120.

As shown in FIG. 11, because the box-supporting convex portion 4121 of each piece of closing member 4120 touches a floor surface when being open, fall of the storage box 4100 on its front is prevented.

According to the fourth exemplary embodiment described above, the same effect as the third exemplary embodiment can be obtained.

Meanwhile, each of the exemplary embodiments mentioned above can be combined with each other within a range where their contents do not disagree with each other. Although the structure and the like of each part have been described specifically in the exemplary embodiments mentioned above, such structure can be changed variously within the range satisfying the present invention.

In addition, part or all of the above-mentioned embodiments can be described as, but not limited to, the following supplementary notes.

(Supplementary Note 1)

A display portable device, comprising: a panel storage box to store a display panel of another body to display image data on an image display screen; a panel fixing means for fixing the display panel inside the panel storage box; an image-visible window part to make image data visible, the image-visible window part being opposite to the image display screen of the display panel fixed inside the panel storage box; and a window part closure member to close the image-visible window part of the panel storage box openably and closably.

(Supplementary Note 2)

The display portable device according to supplementary note 1, wherein the panel fixing means fixes the display panel at a position not to make outside of the display panel touch inside of the panel storage box.

(Supplementary Note 3)

The display portable device according to supplementary note 1 or 2, wherein the panel fixing means fixes the display panel such that the image display screen inclines relative to the image-visible window part of the panel storage box.

(Supplementary Note 4)

The display portable device according to any one of supplementary notes 1 to 3, wherein the window part closure member is formed into a plate-like shape to close the image-visible window part, and wherein the panel storage box has a window part closure means for making the window part closure member seal the image-visible window part.

(Supplementary Note 5)

The display portable device according to supplementary note 4, wherein the panel storage box has a member supporting mechanism to support the window part closure member attachably and detachably in an outside face of the panel storage box opposite to the image-visible window part.

(Supplementary Note 6)

The display portable device according to any one of supplementary notes 1 to 3, wherein the image display screen of the display panel is formed into an approximately rectangle shape, wherein the image-visible window part of the panel storage box is formed into an approximately rectangle shape, and wherein at least one window part closure member is rotatably attached to at least one of four sides of the approximately rectangular image-visible window part.

(Supplementary Note 7)

The display portable device according to supplementary note 6, wherein the panel storage box is formed into a shape enabling the image-visible window part to be rearranged in a state being approximately vertical, wherein at least one window part closure member is rotatably attached to an upper fringe part of the image-visible window part of an approximately vertical state, and wherein the panel storage box also has a member supporting mechanism to support the window part closure member opened toward an upper side from the image-visible window part.

(Supplementary Note 8)

The display portable device according to supplementary note 6 or 7, wherein the panel storage box is formed into a shape enabling the image-visible window part to be rearranged in a state being approximately vertical, and wherein a pair of window part closure members is rotatably attached to both side ends of the image-visible window part of a state being approximately vertical.

(Supplementary Note 9)

The display portable device according to supplementary note 7, wherein the panel storage box is formed into a shape enabling the image-visible window part to be rearranged in a state being approximately vertical, and at least three window part closure members are rotatably attached to an upper fringe part and each of both side ends of the image-visible window part of an approximately vertical state individually, and wherein the window part closure member opened toward the upper side from the image-visible window part is held by a pair of window part closure members opened toward both sides.

(Supplementary Note 10)

A portable display device, comprising: a display portable device according to any one of supplementary notes 1 to 9: and a display panel stored in the panel storage box of the display portable device and fixed by the panel fixing means.

(Supplementary Note 11)

The display portable device according to any one of supplementary notes 1 to 9, wherein at least one of the panel storage box and the window part closure member has antireflection inner surface.

(Supplementary Note 12)

The display portable device according to supplementary note 11, wherein at least one of the panel storage box and the window part closure member has black inner surface.

(Supplementary Note 13)

The display portable device according to any one of supplementary notes 6 to 9, 11 and 12, wherein the panel storage box is formed into a shape enabling the image-visible window part to be rearranged in a state being approximately vertical, wherein at least one window part closure member is rotatably attached to a lower fringe part of the image-visible window part of an approximately vertical state, and wherein a window part closure member opened toward a lower side from the image-visible window part supports the panel storage box in a state that the image-visible window part is approximately vertical.

(Supplementary Note 14)

The display portable device according to any one of supplementary notes 6 to 9, and 11 to 13, wherein the panel storage box is formed into a shape enabling the image-visible window part to be rearranged in a state being approximately vertical, wherein a pair of window part closure members is rotatably attached to both side ends of the image-visible window part of an approximately vertical state, and wherein the window part closure members opened toward the both sides support the panel storage box in a state making the image-visible window part be approximately vertical.

(Supplementary Note 15)

The display portable device according to any one of supplementary notes 1 to 9, and 11 to 14, wherein the panel storage box is formed into a shape enabling the image-visible window part to be rearranged in a state being approximately vertical, wherein at least one box supporting member is openably and closably attached to an outside face of the panel storage box in a side opposite to the image-visible window part, and wherein the box supporting member made to be opened supports the panel storage box in a state making the image-visible window part be approximately vertical.

(Supplementary Note 16)

The display portable device according to any one of supplementary notes 1 to 9, and 11 to 15, wherein the image-visible window part of the panel storage box formed as a penetration hole is sealed by a translucent plate.

(Supplementary Note 17)

The display portable device according to any one of supplementary notes 1 to 9, and 11 to 16, wherein the panel storage box and the window part closure member are formed having a heat insulating property.

Although the present invention has been described with reference to the various exemplary embodiments above, the present invention is not limited to each of the above-mentioned exemplary embodiments. Various modifications which a person skilled in the art can understand can be performed in the composition and details of the present invention within the scope of the present invention.

This application is based upon and claims the benefit of priority from Japanese patent application No. 2012-075420, filed on Mar. 29, 2012, the disclosure of which is incorporated herein in its entirety by reference.

INDUSTRIAL APPLICABILITY

The present invention can be widely applied to the carrying of a display and equipment similar to a display.

REFERENCE SIGNS LIST

1000 Display carrier
1100 Storage box
1110 Window part
1120 Fixing member
1130 Closing member
1150 Supporting member
1200 Display
1210 Display screen
2000 Display carrier
2100 Storage box
2110 Hinge mechanism
2131 Closing member
2132 Closing member
2133 Closing member
2134 Closing member
2200 Stopper
2300 Leg part
3000 Display carrier
3110 Closing member
3111 First closing part
3112 Second closing part
3200 Box supporting member
4000 Display carrier
4100 Storage box
4110 Window part
4120 Closing member
4121 Box-supporting convex portion

The invention claimed is:

1. A portable type display device comprising:

a display including a screen on a front surface thereof and a rear surface opposite the screen; and a display carrier, comprising:

a storage box configured to store the display, the storage box having a bottom surface, a window part which is formed on a face of the storage box opposite the bottom surface of the storage box, a fixing member disposed entirely within only a central area of the storage box and extending from the bottom surface of the storage box, the central area being defined between the bottom surface of the storage box and the window part of the storage box, the fixing member having a bottom surface fixed to the bottom surface of the storage box and an upper surface opposite the bottom surface of the fixing member, the upper surface of the fixing member being inclined, the rear surface of the display being joined to the inclined upper surface of the fixing member such that the screen is inclined with respect to the window part, and a closing member which closes said window part, wherein a supporting member configured to support said closing member removed from said window part is provided on a face of said storage box opposite to a face having said window part formed.

2. The display device according to claim 1, wherein said fixing member is configured to fix said display at a position not allowing an outside face of said display to touch an inside face of said storage box.

3. The display device according to claim 1, wherein said closing member is formed of one plate-shape member configured to be attached to and detached from said storage box.

4. The display device according to claim 3, wherein said closing member is attached to a sealing member formed in a periphery of said window part when said closing member closes said window part.

* * * * *